US007896571B1

(12) United States Patent
Hannig et al.

(10) Patent No.: US 7,896,571 B1
(45) Date of Patent: Mar. 1, 2011

(54) PANEL AND PANEL FASTENING SYSTEM

(75) Inventors: Hans-Jurgen Hannig, Bergisch (DE); Ralf Eisermann, Cochem (DE)

(73) Assignee: Akzenta Paneele + Profile GmbH, Kaisersesch (DE)

( * ) Notice: Subject to any disclaimer, the term of this patent is extended or adjusted under 35 U.S.C. 154(b) by 0 days.

(21) Appl. No.: 10/019,195

(22) PCT Filed: Oct. 9, 1999

(86) PCT No.: PCT/DE99/03259

§ 371 (c)(1),
(2), (4) Date: Jun. 3, 2002

(87) PCT Pub. No.: WO01/02670

PCT Pub. Date: Jan. 11, 2001

(30) Foreign Application Priority Data

Jun. 30, 1999 (DE) ..... 199 29 896
Jul. 2, 1999 (DE) ..... 299 11 462 U

(51) Int. Cl.
*A47B 96/06* (2006.01)
*E04B 2/00* (2006.01)

(52) U.S. Cl. ..... 403/339; 403/340; 52/582.1; 52/586.1; 52/588.1; 52/589.1

(58) Field of Classification Search ..... 403/339, 403/340, 331; 52/582.1, 588.1, 586.1, 589.1, 52/592.1, 592.3, 592.4, 381, 578, 581, 591.1
See application file for complete search history.

(56) References Cited

U.S. PATENT DOCUMENTS

| | | | | |
|---|---|---|---|---|
| 338,653 | A * | 3/1886 | Whitmore | 403/340 |
| 890,436 | A | 6/1908 | Momberg | |
| 1,776,188 | A | 9/1930 | Langbaum | |
| 1,854,396 | A | 4/1932 | Davis | |
| 2,138,085 | A | 11/1938 | Birtles | |
| 2,142,305 | A | 1/1939 | Davis | |
| 2,360,933 | A * | 10/1944 | Bunker | |
| 2,381,469 | A | 8/1945 | Sweet | |

(Continued)

FOREIGN PATENT DOCUMENTS

| | | |
|---|---|---|
| BE | 417526 | 10/1936 |

(Continued)

OTHER PUBLICATIONS

Webster's II New Riverside University Dictionary, 1984, 'scarf', pp. 1042-1043, Houghton Mifflin Company, Boston, MA .

*Primary Examiner* — Victor MacArthur
(74) *Attorney, Agent, or Firm* — Lucas & Mercanti, LLP

(57) ABSTRACT

A panel fastening system, especially for floor panels. The floor panels are fitted with retaining profiles on their edges, whereby the retaining profile of a front edge and the retaining profile of the opposite back edge and the retaining profile of a left edge and the retaining profile of the opposite right edge of a panel match each other in such a way that similar panels can be fixed to one another. The mutually matching retaining profiles have complementary hook elements that can be hooked into one another and the hook elements have retaining surfaces by means of which the panels are held against each other when mounted in such a way that a gap-free surface is obtained.

7 Claims, 11 Drawing Sheets

U.S. PATENT DOCUMENTS

| | | | | | |
|---|---|---|---|---|---|
| 2,430,200 | A | | 11/1947 | Wilson | |
| 2,740,167 | A | | 4/1956 | Rowley | |
| 3,040,388 | A | | 6/1962 | Conn | |
| 3,172,508 | A | | 3/1965 | Doering et al. | |
| 3,175,476 | A | | 3/1965 | Franks | |
| 3,192,574 | A | | 7/1965 | Jaffe et al. | |
| 3,200,553 | A | | 8/1965 | Frashour et al. | |
| 3,310,919 | A | | 3/1967 | Bue et al. | |
| 3,347,048 | A | | 10/1967 | Brown | |
| 3,526,420 | A | | 9/1970 | Brancaleone | |
| 3,579,941 | A | | 5/1971 | Tibbals | |
| 3,657,852 | A | | 4/1972 | Worthington et al. | |
| 3,673,751 | A | | 7/1972 | Boassy et al. | |
| 3,731,445 | A | * | 5/1973 | Hoffmann et al. | |
| 3,902,291 | A | | 9/1975 | Zucht | |
| 3,921,312 | A | * | 11/1975 | Fuller | 52/589.1 |
| 3,988,187 | A | | 10/1976 | Witt et al. | |
| 4,094,090 | A | | 6/1978 | Walmer | |
| 4,416,097 | A | | 11/1983 | Weir | |
| 4,426,820 | A | | 1/1984 | Terbrack et al. | |
| 4,599,841 | A | | 7/1986 | Haid | |
| 4,741,136 | A | | 5/1988 | Thompson | |
| 4,819,532 | A | | 4/1989 | Benuzzi et al. | |
| 4,819,932 | A | | 4/1989 | Trotter, Jr. | |
| 5,086,599 | A | | 2/1992 | Meyerson | |
| 5,165,816 | A | | 11/1992 | Parasin | |
| 5,283,102 | A | | 2/1994 | Sweet et al. | |
| 5,295,341 | A | | 3/1994 | Kajiwara | |
| 5,348,778 | A | * | 9/1994 | Knipp et al. | 428/35.8 |
| 5,618,602 | A | | 4/1997 | Nelson | |
| 5,630,304 | A | | 5/1997 | Austin | |
| 5,706,621 | A | | 1/1998 | Pervan | |
| 5,797,237 | A | | 8/1998 | Finkell, Jr. | |
| 5,860,267 | A | | 1/1999 | Pervan | |
| 6,006,486 | A | | 12/1999 | Moriau et al. | |
| 6,023,907 | A | | 2/2000 | Pervan | |
| 6,029,416 | A | | 2/2000 | Andersson | |
| 6,094,882 | A | | 8/2000 | Pervan | |
| 6,098,365 | A | | 8/2000 | Martin et al. | |
| 6,101,778 | A | * | 8/2000 | M.ang.rtensson | 52/591.1 |
| 6,122,879 | A | | 9/2000 | Montes | |
| 6,182,410 | B1 | | 2/2001 | Pervan | |
| 6,209,278 | B1 | * | 4/2001 | Tychsen | 52/592.4 |
| 6,216,409 | B1 | | 4/2001 | Roy et al. | |
| 6,505,452 | B1 | * | 1/2003 | Hannig et al. | 52/592.1 |
| 6,647,690 | B1 | * | 11/2003 | Martensson | 52/591.1 |
| 6,763,643 | B1 | | 7/2004 | Martensson | |

FOREIGN PATENT DOCUMENTS

| | | | | |
|---|---|---|---|---|
| BE | 418853 | | | 1/1937 |
| BE | 765.817 | | | 9/1971 |
| CA | 991373 | B | | 6/1976 |
| CA | 2150384 | A1 | | 11/1994 |
| CH | 200949 | | | 11/1938 |
| CH | 562377 | | | 4/1975 |
| DE | 1 963 128 | | | 6/1967 |
| DE | 2 159 042 | | | 6/1973 |
| DE | 7402354 | | | 5/1974 |
| DE | 25 02 992 | A1 | | 7/1976 |
| DE | 26 16 077 | A1 | | 10/1977 |
| DE | 29 17 025 | A1 | | 11/1980 |
| DE | 79 28 703 | U1 | | 7/1981 |
| DE | 30 41 781 | A1 | | 6/1982 |
| DE | 31 17 605 | A1 | | 11/1982 |
| DE | 33 43 601 | A1 | | 6/1985 |
| DE | G 90 04 451.7 | | | 8/1990 |
| DE | 41 22 099 | C1 | | 10/1992 |
| DE | 42 15 273 | A1 | | 11/1993 |
| DE | 195 03 948 | A1 | | 8/1996 |
| DE | 299 11 462 | U1 | | 12/1999 |
| EP | 0 024 360 | A1 | | 3/1981 |
| EP | 0 085 196 | A1 | | 8/1983 |
| EP | 220389 | A2 | * | 5/1987 |
| EP | 0 161 233 | B1 | | 10/1987 |
| EP | 0 248 127 | A1 | | 12/1987 |
| EP | 0 562 402 | A1 | | 9/1993 |
| EP | 0 698 162 | B1 | | 2/1996 |
| EP | 0 715 037 | A1 | | 6/1996 |
| EP | 0 843 763 | B1 | | 12/1997 |
| EP | 0 855 482 | B1 | | 7/1998 |
| EP | 0 877 130 | B1 | | 11/1998 |
| FR | 1.215.852 | | | 4/1960 |
| FR | 1.293.043 | | | 12/1962 |
| FR | 1293043 | | * | 12/1962 |
| FR | 1.511.292 | | | 1/1968 |
| FR | 2.135.372 | | | 12/1972 |
| FR | 2 278 876 | | | 2/1976 |
| FR | 2 416 988 | | | 9/1979 |
| FR | 2 568 295 | A1 | | 1/1986 |
| FR | 2 691 491 | A1 | | 11/1993 |
| GB | 424057 | | | 2/1935 |
| GB | 599793 | | | 3/1948 |
| GB | 647812 | | * | 12/1950 |
| GB | 812671 | | | 4/1959 |
| GB | 1127915 | | | 9/1968 |
| GB | 1 237 744 | | | 6/1971 |
| GB | 1 275 511 | | | 5/1972 |
| GB | 1 430 423 | | | 3/1976 |
| GB | 2 117 813 | A | | 10/1983 |
| GB | 2 256 023 | A | | 11/1992 |
| JP | 3169967 | A2 | | 7/1991 |
| JP | 04203141 | | | 7/1992 |
| JP | 05304714 | | | 11/1993 |
| JP | 7180333 | | | 7/1995 |
| JP | 08-109734 | | | 4/1996 |
| SE | 7114900-9 | | | 12/1974 |
| SE | 457 737 | | | 1/1989 |
| WO | WO 84/02155 | A1 | | 6/1984 |
| WO | WO 93/13280 | A1 | | 7/1993 |
| WO | WO 9747834 | A1 | * | 12/1997 |
| WO | 0020706 | | | 4/2000 |
| WO | WO 00/63510 | | | 10/2000 |
| WO | WO 0063510 | A1 | * | 10/2000 |
| WO | WO 01/02671 | A1 | | 1/2001 |

* cited by examiner

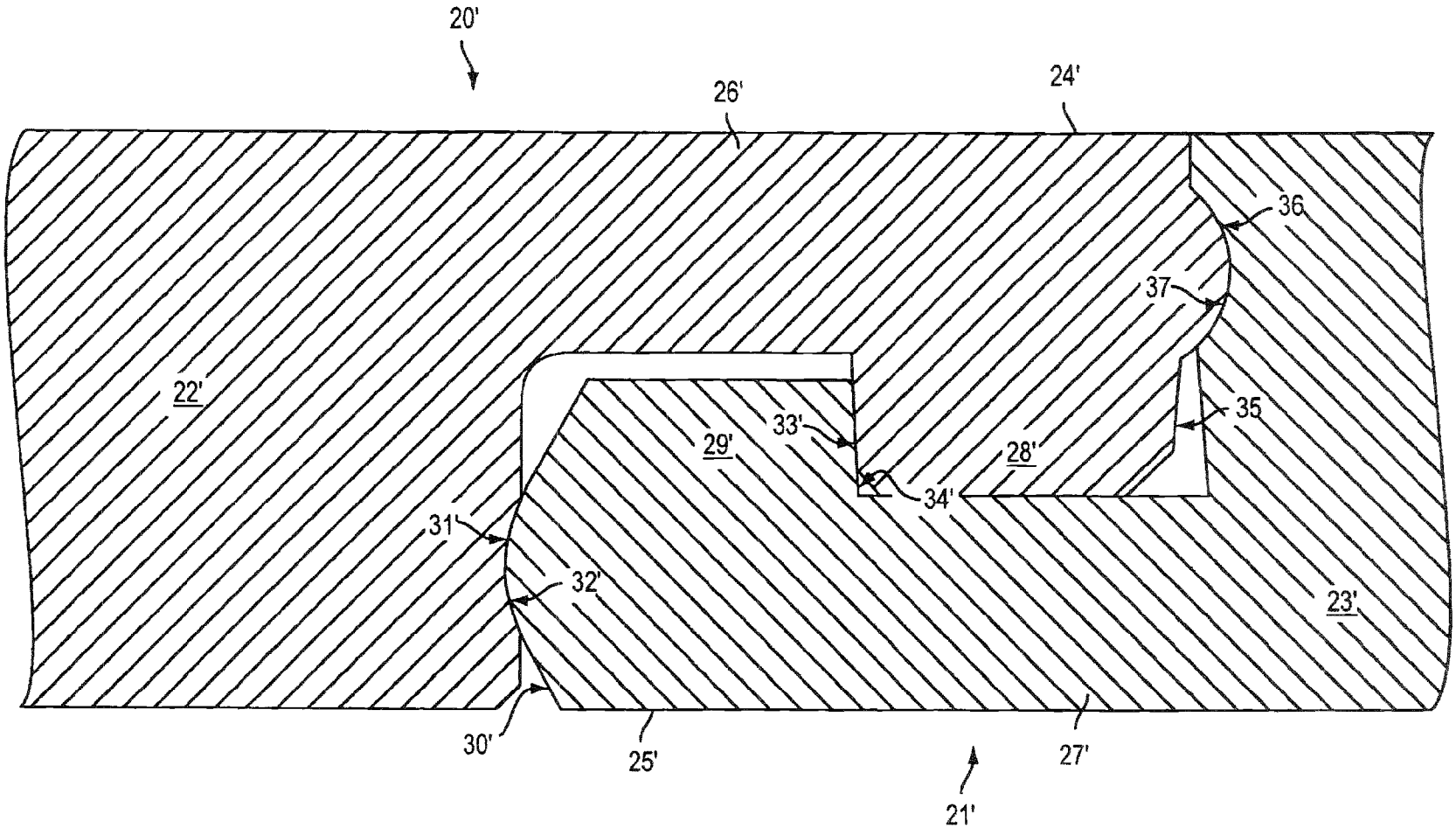
FIG. 5.1

PANEL AND PANEL FASTENING SYSTEM

BACKGROUND OF THE INVENTION

The invention relates to a fastening system for panels, with retaining profiles arranged at the narrow sides of the panels, in particular for floor panels, wherein mutually opposite retaining profiles of a panel match each other in such a way that similar panels can be fastened to one another, wherein at least one pair of oppositely disposed retaining profiles has complementary hook elements that can be hooked one into the other and that the hook elements have hook projections with retaining surfaces by which the panels, in the assembled condition, are held against each other in such a way that there is a gap-free floor surface.

A fastening system of the general kind set forth is known from EP 0 715 037 A1. FIGS. 1 and 2 of that publication propose a fastening system whose hook elements can be fitted one into the other by a joining movement perpendicular to the panel laying plane. As can be very clearly seen from FIG. 1 of that publication the connection is very well secured by positive engagement against detachment in the plane of the panels and perpendicularly to the locked longitudinal edge, but the connection is particularly easy to release in its joining direction perpendicularly to the plane in which the panels are laid. In the arrangement of EP 0 715 037 A1 that problem arises for example if a soft underlay for damping the sound of footsteps is provided between the base and the panels. If only that panel whose hook elements are towards the base are loaded in the proximity of a joint, it moves downwardly into the soft underlay for damping the sound of footsteps and moves out of the hooking engagement with the associated hook element of the adjacent panel which is not loaded.

In a flat assembly comprising a very large number of individual panels, a problem, which arises, is that of re-engaging a hook connection once it has come undone because the hook element that is associated with the base cannot be urged upwardly as it is not accessible.

The durability of the connection, particularly in the direction of the perpendicular joining movement, is therefore completely inadequate.

SUMMARY OF THE INVENTION

Therefore, the object of the invention is to provide a fastening system that is of a simple design configuration and is more durable than the known fastening system.

In accordance with the invention that object is attained in that the retaining surfaces of the hook projections are inclined, such that the hook projections decrease from their free ends towards the legs and the retaining surfaces of the complementary hook projections bear against each other at least in a region-wise manner.

This measure ensures that the retaining surfaces of the hook projections engage behind each other in such a way that they can be hooked into each other only by elastic deformation. Release of the connection in a direction perpendicular to the plane in which the panels are laid is resisted by the retaining surfaces engaging behind each other.

In a simple manner, a first retaining profile of a panel is provided with a hook element formed from a leg that projects approximately perpendicularly from the narrow side and is arranged at the top side of the panel, wherein arranged at the free end of the leg is a hook projection that faces towards the underside of the panel. The rear retaining profile of the panel is provided with a hook element formed from a leg that projects from the narrow side and is arranged at the underside of the panel, wherein arranged at the free end of said leg is a hook projection that faces towards the top side of the panel.

The top side of the panel forms a transition into the leg from the region involving the thickness of the complete panel, with a step in respect of the thickness of the panel. The leg is approximately of a thickness that corresponds to a third of the thickness of the panel. The same applies to the underside of the panel. In opposite relationship to the hook element of the top side, the leg at the underside forms a transition into the leg from the region of the complete thickness of the panel, with a step in respect of the panel thickness, the leg also being of a thickness that is about a third the thickness of the panel. The legs and the hook projections are substantially more massive than the undercut configuration of the known groove-and-tongue connection. That therefore involves an improvement in the strength and durability of the fastening system according to the invention.

Advantageously the hook projection of the leg at the underside bears, in the assembled condition of a panel, against the leg at the top side of a second panel. In addition, clearance is provided between the hook projection of the leg at the top side of the second panel and the leg at the underside of the first panel.

It will be appreciated that this can also be reversed so that clearance can be provided between the hook projection of the leg at the underside of the first panel and the leg at the top side of the second panel. What is important is that a pair of leg/hook projection, in the assembled condition, always bear clearly against each other, and the other leg/hook projection pair has clearance therebetween. If the fastening system were so designed that both leg/hook projection pairs always bear against each other, then tolerances in manufacture of the retaining profiles mean that well-defined contact therebetween would not be achieved and sometimes one leg/hook projection pair and sometimes another leg/hook projection pair would bear against each other.

A development of the fastening system provides that the retaining surfaces of the hook projections engage behind each other in such a way that complementary hook projections can be hooked one into the other only by elastic deformation. The panels are thus arrested perpendicularly to the plane of laying thereof.

It is possible in that way to ensure that the retaining elements cannot be moved away from each other for example due to an uneven base, when subjected to a loading. When a panel is subjected to a loading, the connected panel is moved with the loaded panel in the same direction. The joint remains together.

A further advantage is achieved if the end of the hook projection at the top side of the one panel in the assembled condition bears, at least in the region of the top side of the panel, against the second panel and clearance is provided between the hook projection at the underside of the second panel and the end of the first panel. That measure again serves to provide that there is always a clear condition of contact between two connected panels, by virtue of the structural configuration involved.

An alternative embodiment provides that at least one of the ends of a hook element of a panel has at its free end a projecting detent or latching element that, in the assembled condition, engages into an undercut recess of the hook element of the other panel.

This structure has been found to be particularly good to handle because the retaining profiles can be latched one into the other under light pressure and with elastic deformation. In addition, the hook elements enjoy good resistance to wear, which is advantageous in terms of multiple laying. The resistance to wear is good for the reason that different arresting functions are performed by different hook element regions and the loading on the hook element thus occurs in a distributed fashion. The panels are arrested for example by the detent element and the recess, perpendicularly to the plane in which the panels are laid. In contrast, the arresting action for the panels to prevent them from being pulled apart in the longitudinal direction thereof is afforded by the retaining surfaces of the hook projections.

In a simple manner the projecting detent element of the first panel is in the form of a bead that extends over the entire length of the narrow side and the undercut recess of the second panel is in the form of an elongate channel that receives the bead in the assembled condition. To form the joint, the bead and the channel have to be fitted one into the other with elastic deformation of the hook elements.

This embodiment of the fastening system is particularly suitable for multiple laying, when no gluing is effected, by virtue of its resistance to wear. It is also inexpensive to manufacture.

In the region of the joint a clearance gap can be tolerated between the panels at the underside of the panels that are laid on a support base, for example a floor finishing layer.

A further improvement provides that the regions provided with clearance in the assembled condition of two panels form adhesive pockets.

Besides use of the proposed fastening system for adhesive-free laying of floor panels, it is particularly suitable for making a joint with adhesive.

For that purpose those locations of the retaining profiles, which have to be provided with adhesive, are identified for example in instructions for use or by markings on the retaining profile itself. In that way, the user can apply adhesive very accurately where adhesive pockets occur in the assembled condition of two panels.

In the predominant situations of use of the floor panels, the glued form of laying same is considered to be the most appropriate fashion of laying the panels. That is because the durability of the panels is markedly improved. Securing the retaining profiles by adhesive provides that dirt and moisture are virtually prevented from penetrating into the joints. The absorption of moisture and swelling of the panels in the joint region of the retaining profiles is minimized thereby.

It will be appreciated that there can be situations of use for which adhesive-free laying is to be preferred. For example, when a floor covering when laid has to be frequently taken up again and re-laid, for example when dealing with floors in setting up fairs and exhibitions.

An embodiment that is simple and durable has been found to be a structure in which the retaining profiles of the long sides are in the form of complementary positively engaging profiles, wherein the positively engaging profile of one panel forms a common hinge with the complementary positively engaging profile of a second panel in the laid condition and the hinge is to be assembled by a rotary joining movement of the panels. By virtue of that pivotability between the long sides, that connecting location between the panels is protected from severe material damage and breakage of the retaining profiles.

By virtue of the presence of the hinge, the panels can be bent upwardly and downwardly at the connecting location. If, for example, a panel is resting on a support base with a raised portion so that when a loading is applied a narrow side of the panel is pressed on to the support base and the oppositely disposed narrow side rocks upwardly, then a second panel, which is fastened to the upwardly moving narrow side, is also moved upwardly. The flexural forces that are operative in that situation however do not damage the narrow cross-sections of the positively engaging profiles. Instead, a pivotal movement takes place. This structure takes account of the principle of 'matched deformability'. That principle is based on the realization that very stiff and accordingly allegedly stable connecting locations give rise to high levels of notch stresses and easily fail as a result. In order to avoid this, components are to be designed in such a way that they have 'matched deformability' or flexibility that is suitably adapted to the purpose of use, and in that way notch stresses can be reduced.

A floor laid with the proposed fastening system has a flexibility that is adapted to irregular rough or corrugated base surfaces. This measure therefore enhances the durability of the panels. The fastening system is therefore particularly well suited for panels for renovating irregular floor surfaces in old buildings.

Even in the case of a flat base, panels can suffer from an alternate flexing effect, more specifically if a soft underlay, for example a sheet for deadening the sound of footsteps, or the like, is laid on the base. At a loaded location, the underlay is depressed and the panels flex at their connecting locations. The fastening system is also better suited for this kind of panel laying than the known fastening systems.

A further advantage is that panels with the fastening system according to the invention are better suited to multiple laying than panels with the known fastening system because the panels with the fastening system according to the invention, even after a long period of use on an irregular base, do not have any early signs of damage to the positively engaging profiles. The positively engaging profiles are stable in respect of shape and durable. They can be used for a substantially longer time and can be re-laid more frequently because of their service cycle.

In a simple embodiment, the hinge is formed from an opening in the side of the first panel and a matching projection on the complementary side of the second panel. The positively engaging profiles are preferably of such a design that a loading at the top side of the floor panels in the laid condition is transmitted from the top wall of the opening in a first panel to the projection of the second panel and from the projection of the second panel to the wall at the underside of the first panel. In the laid condition, the walls of the opening in the first panel are in contact with the top side and the underside of the projection of the second panel. The top wall of the opening however is in contact with the projection of the second panel only in a short region at the free end of the upper wall of the opening. In that way the structure permits a hinge movement between the panel with the opening and the panel with the projection, with slight elastic deformation of the walls of the opening. In that way the stiffness of the connection is best matched to an irregular base, which inevitably results in a bending movement between panels that are fastened to each other.

In a simple structure, the hinge is formed from a concave curvature in the inward wall of the opening that is towards the base, and a convex curvature at the underside of the projection, that is towards the base. In addition, the top side of the projection of a panel, which is remote from the base, has an inclined removal of material that extends to the free end of the projection. The thickness of the projection is increasingly reduced towards the free end by the removal of material. A free space for movement is afforded for the common hinge by the removal of material.

In order to take up laid panels again, desirably firstly a row of panels disposed in mutually juxtaposed relationship are lifted in such a way that they rotate inclinedly upwardly in the hinge. The projections are then pulled in an inclined direction out of the openings and the hinge is taken apart. The panels are then only joined at the short sides. It is recommended that the interengaged hook elements of the short sides should be pulled apart in their longitudinal extent, in order in that way in the disconnection procedure to avoid deformation of the hook elements, such as to cause material fatigue.

Advantageously the convex curvature of the projection and the concave curvature of the opening substantially form a portion of a circle, wherein the centre point of the portion of the circle is on or beneath the top side of the projection, in the laid condition. In the latter case, the centre point of the circle is within the cross-section of the projection.

This simple design configuration affords a hinge in which the convex curvature of the projection is similar to a hinge ball and the concave curvature of the recess is similar to a hinge socket, in which respect as will be appreciated, unlike a ball-and-socket joint, no spherical movement but only a straightforward rotational movement is possible.

In an advantageous development, the furthest projecting point of the convex curvature of the projection of a panel is so arranged that it is somewhat below the upper edge of the panel. That means that the projection is of a cross-section that is relatively large in comparison with the overall thickness of the panel. In addition, the concave curvature of the opening affords a sufficiently large undercut configuration for the convex curvature of the projection so that they can scarcely be moved away from each other by virtue of the tensile forces acting in the plane in which the panels are laid.

The hinge properties of two interconnected panels can be further improved if the wall of the opening of a panel, which is towards the base, has on its inside an inclined removal of material which extends to the free end of the wall and the wall thickness of said wall is increasingly thinner towards the free end. In that case, a free space for movement for the common hinge is provided by the removal of material, in the laid condition of two panels.

With that improvement, the amount of elastic deformability of the walls of the opening is further reduced, during flexing of the laid panels in an upward direction.

It is also desirable if the opening of a panel can be enlarged for connection to the projection of a further panel by resilient deformation of its lower wall and the resilient deformation of the lower wall, which occurs during the joining operation, is reversed again in the finished joined condition of two panels. In that way the positively engaging profiles are elastically deformed only for the joining operation and during a pivotal hinge movement and are not subjected to any elastic stressing when they are not loaded.

Preferably, the positively engaging profiles are formed integrally at the narrow sides of the panels. The panels can be produced very easily and with a low level of waste.

It has been found that the strength of modern carrier materials such as for example medium density fibreboard (MDF) or high density fibreboard (HDF) that are provided with a wear-resistant working layer are particularly suitable for use of the fastening system proposed. Those materials are simple to machine and achieve adequate surface quality, for example by a cutting machining operation. In addition, those materials enjoy high stability in respect of shape of the milled profiles. Even after having been laid a plurality of times the retaining profiles are still so good in terms of shape that a secure joint is possible, even on an uneven base.

A further advantage is afforded if, in the laid condition of the panels, the free spaces for movement for the common hinges are provided with a filler that hardens in soft-elastic form. That filler preferably closes all joints and in particular the joint at the top side, in such a way that no moisture and no dirt can penetrate. Upon a hinge movement of the interconnected panels, the soft-elastic filler is squeezed or stretched, depending on the direction of rotation of the hinge movement. In that situation, it always adheres to the contact surfaces of the narrow sides of the panels and returns to its initial shape upon return of the hinge movement. The filler contributes to the return movement of the hinge, by virtue of the elastic internal deformation of the filler.

BRIEF DESCRIPTION OF THE DRAWINGS

The invention is described in greater detail hereinafter with reference to the Figures and illustrated by way of example in a drawing in which.

DETAILED DESCRIPTION OF THE PREFERRED EMBODIMENTS

Figure 1:
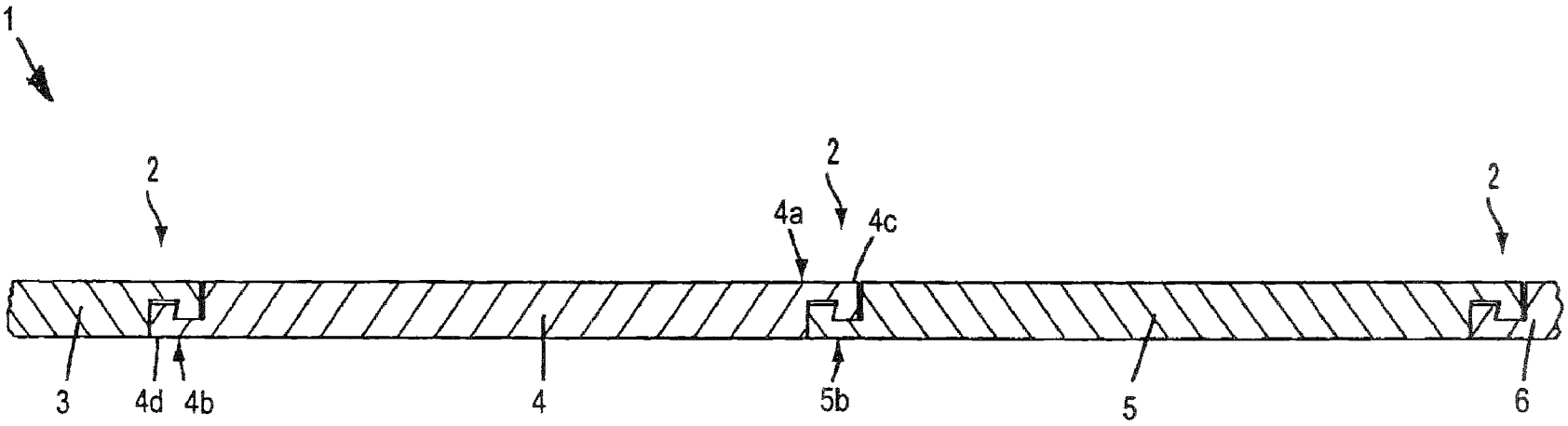
FIG. 1 is a diagrammatic side view of a laid floor covering comprising panels with the fastening element according to the invention with hook elements.

Referring to FIG. 1 of the drawing a floor covering 1 with the proposed fastening system 2 is composed of a plurality of similar panels 3, 4, 5 and 6. The first panel 4 has at mutually opposite narrow sides mutually matching retaining profiles 4*a* and 4*b* with complementary hook elements 4*c* and 4*d*. In that way, it is always possible for a first retaining profile 4*a* to be joined to a second retaining profile 5*b* of a second panel 5.

Figure 2:
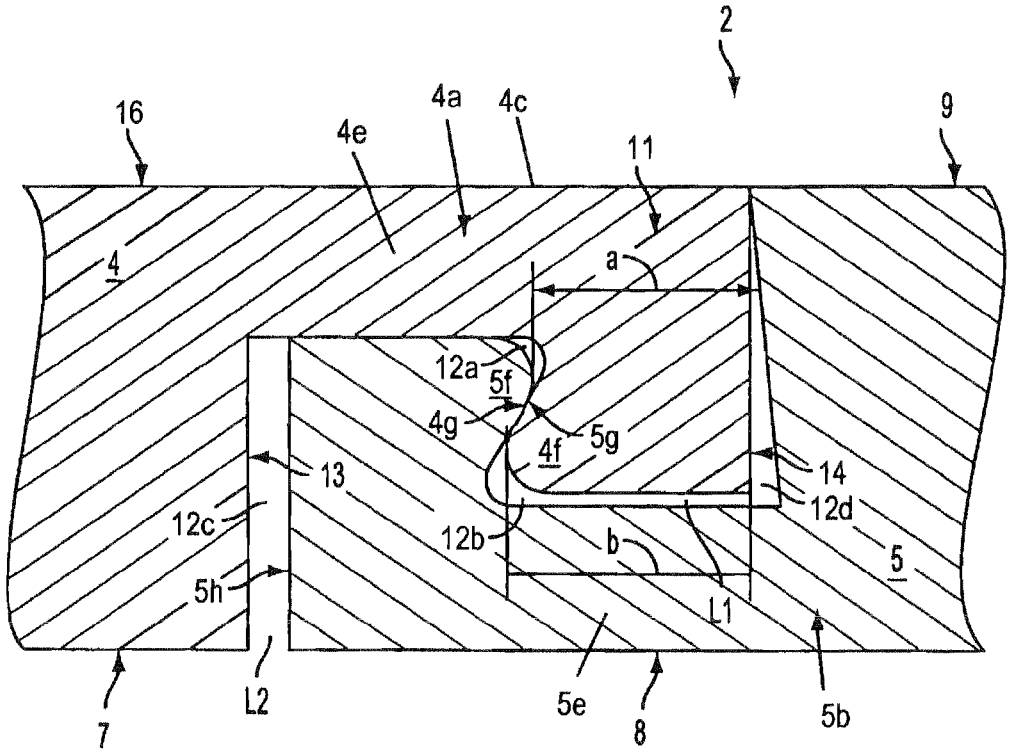
FIG. 2 is a side view of part of an embodiment of the fastening system with hook elements.

FIG. 2 shows a side view on an enlarged scale of a portion of an embodiment of the fastening system 2. FIG. 2 shows a first retaining profile 4*a* of a panel 4 with a hook element 4*c* that is formed from a leg 4*e* that projects substantially perpendicularly from the narrow side and is arranged at the top side 16 of the panel 4. In this case, a hook projection 4*f* that faces towards the underside 7 of the panel 4 is arranged at the free end of the leg 4*e*. The hook projection 4*f* is in engagement with a hook projection 5*f* of a second panel 5. The hook projection 5*f* of the second panel 5 forms the retaining profile of the rear narrow side. It is also formed from a leg 5*e* that projects from the narrow side of the second panel 5 and is arranged at the underside 8 of the second panel 5. The hook projection 5*f* is also arranged at the free end of the leg 5*e* and faces towards the top side 9 of the panel 5. The hook projections 4*f* and 5*f* of the two panels 4 and 5 are hooked one into the other.

The hook projection 5*f* of the second panel 5 with the leg 5*e* at the underside bears, in the assembled condition of the first panel 4, against the leg 4*e* at the top side of the second panel 5. For the purposes of affording well-defined contact, clearance L1 is provided between the hook projection 4*f* of the leg 4*e* at the top side of the first panel 4 and the leg 5*e* at the underside of the second panel 5 in the present embodiment.

As shown in FIG. 2, retaining surfaces 4*g* and 5*g* of the hook projections 4*f* and 5*f* engage one behind the other in such a way that the hook projections 4*f* and 5*f* can be hooked one into the other only by elastic deformation. Formed between the inside surface of the hook profile of the second panel 5 and the oppositely disposed retaining surface 4*g* of the hook projection 4*f* is an opening 11 that, at its narrowest location, is of a width a and that is less than the width b of the hook projection 4*f* of the first panel 4 at its widest location. By virtue of that configuration and due to elastic deformation when joining the hook projections 4*f* and 5*f*, the complementary hook projections 4*f* and 5*f* involve a snapping engagement into a defined end position. In the present embodiment, the retaining surfaces 4*g* and 5*g* of the hook projections 4*f* and 5*f* are kept simple and are in the form of inclinedly disposed flat surfaces. They decrease from the free ends of the hook projections 4*f* and 5*f* towards the legs 4*e* and 5*e*. In the present embodiment, as can be seen in FIG. 2, the retaining surface 4*g* of the hook projection 4*f* of the first panel 4 is rounded off at the upper and the lower ends. The same applies for the retaining surface 5*g* of the hook projection 5*f* of the second panel 5. That promotes interengagement of the hook projections 4*f* and 5*f* insofar as, during a joining movement that is perpendicular to the plane in which the panels are laid, the retaining profiles 4*a* and 5*b* are slowly elastically spread open. That facilitates the laying procedure and protects the retaining profiles 4*a* and 5*b*.

The retaining surfaces 4*g* and 5*g*, which bear against each other, of the co-operating panels 4 and 5, therefore bear snugly against each other in a region-wise manner. The resulting intermediate spaces can advantageously serve as adhesive pockets 12*a* and 12*b*.

Clearance L2 is further provided between the end 5*h* of the hook projection 5*f* at the lower side of the second panel 5 and the inside surface 13 of the first panel 4. That resulting intermediate space can also serve as an adhesive pocket 12*c*. The same applies in regard to the end 14 of the hook projection 4*f* at the top side of the first panel 4 that, in the assembled condition, bears against the second panel 5 at least in the region of the top sides 16 and 9 of the panels. In the present embodiment, an intermediate space, which is also in the form of an adhesive pocket 12*d*, is enlarged beneath the top sides 16 and 9 of the panels towards the interior of the joint.

Figure 3:
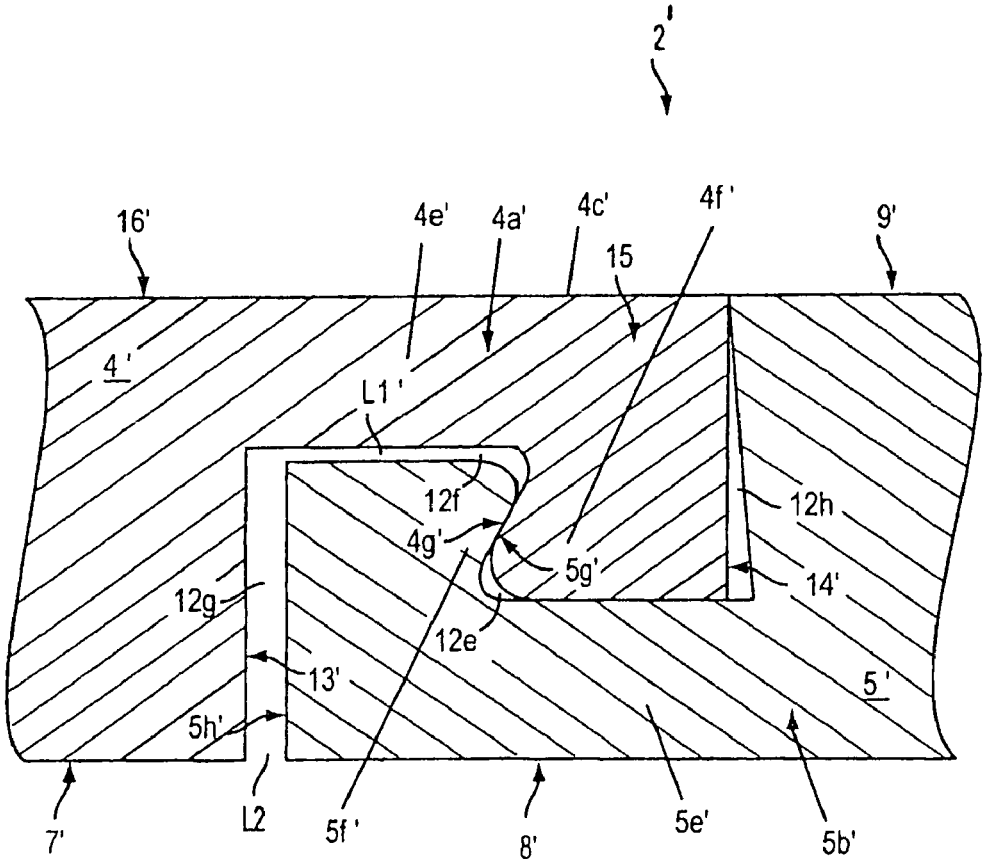
FIG. 3 is a side view of part of a further embodiment of the fastening system with hook elements.

A second embodiment of a fastening system denoted 2' is shown in FIG. 3. Therein the same technical features are denoted by the same reference as in FIG. 2. The embodiment of FIG. 3 differs from the embodiment of FIG. 2 in that one of the two leg/hook projection pairs that bears one against the other and that has an air gap or clearance have changed. The fundamental function of the fastening system 2 and 2' are the same.

FIG. 3 shows a side view on an enlarged scale of a portion of a second embodiment of the fastening system 2. FIG. 3 shows a first retaining profile 4*a'* of a panel 4' with a hook element 4*c'* that is formed from a leg 4*e'* that projects substantially perpendicularly from the edge and is arranged at the top side 16' of the panel 4'. In this case, a hook projection 4*f'* that faces towards the underside 7' of the panel 4' is arranged at the free end of the leg 4*e'*. The hook projection 4*f'* is in engagement with a hook projection 5*f'* of a second panel 5'. The hook projection 5*f'* of the second panel 5' forms the retaining profile of the rear narrow side. It is also formed from a leg 5*e'* that projects from the edge of the second panel 5' and is arranged at the underside 8' of the second panel 5'. The hook projection 5*f'* is also arranged at the free end of the leg 5*e'* and faces towards the top side 9' of the panel 5'. The hook projections 4*f'* and 5*f'* of the two panels 4' and 5' are hooked one into the other.

The hook projection 4*f'* of the first panel 4' with the leg 4*e'* at the top side bears, in the assembled condition of the second panel 5', against the leg 5*e'* at the underside of the second panel 5'. For the purposes of affording well-defined contact, clearance L1' is provided between the hook projection 5*f'* of the leg 5*e'* at the underside of the second panel 5' and the leg 4*e'* at the top side of the first panel 4'.

As shown in FIG. 3, retaining surfaces 4*g'* and 5*g'* of the hook projections 4*f'* and 5*f'* engage one behind the other in such a way that the hook projections 4*f'* and 5*f'* can be hooked one into the other only by elastic deformation. By virtue of that configuration and due to elastic deformation when joining the hook projections 4*f'* and 5*f'*, the complementary hook projections 4*f'* and 5*f'* involve a snapping engagement into a defined end position. In this embodiment, the retaining surfaces 4*g'* and 5*g'* of the hook projections 4*f'* and 5*f'* are kept simple and are in the form of inclinedly disposed flat surfaces. They decrease from the free ends of the hook projections 4*f'* and 5*f'* towards the legs 4*e'* and 5*e'*. In this embodiment, as can be seen in FIG. 3, the retaining surface 4*g'* of the hook projection 4*f'* of the first panel 4' is rounded off at the upper and the lower ends. The same applies for the retaining surface 5*g'* of the hook projection 5*f'* of the second panel 5'. That promotes interengagement of the hook projections 4*f'* and 5*f'* insofar as, during a joining movement that is perpendicular to the plane in which the panels are laid, the retaining profiles 4*a'* and 5*b'* are slowly elastically spread open. That facilitates the laying procedure and protects the retaining profiles 4*a'* and 5*b'*.

The retaining surfaces 4*g'* and 5*g'*, which bear against each other, of the co-operating panels 4' and 5', therefore bear snugly against each other in a region-wise manner. The resulting intermediate spaces can advantageously serve as adhesive pockets 12*e* and 12*f*.

Clearance L2 is provided between the end 5*h'* of the hook projection 5*f'* at the lower side of the second panel 5' and the inside surface 13' of the first panel 4'. That resulting intermediate space can also serve as an adhesive pocket 12*g*. The same applies in regard to the end 14' of the hook projection 4*f'* at the top side of the first panel 4' that, in the assembled condition, bears against the second panel 5' at least in the region of the top sides 16' and 9' of the panels. In this embodiment, an intermediate space, which is also in the form of an adhesive pocket 12*h*, is enlarged beneath the top sides 16' and 9' of the panels towards the interior of the joint. The arrangement once again involves well-defined contact between the hook projections 4*f'* and 5*f'* and a gap-free surface for the floor covering 1.

Figure 4:
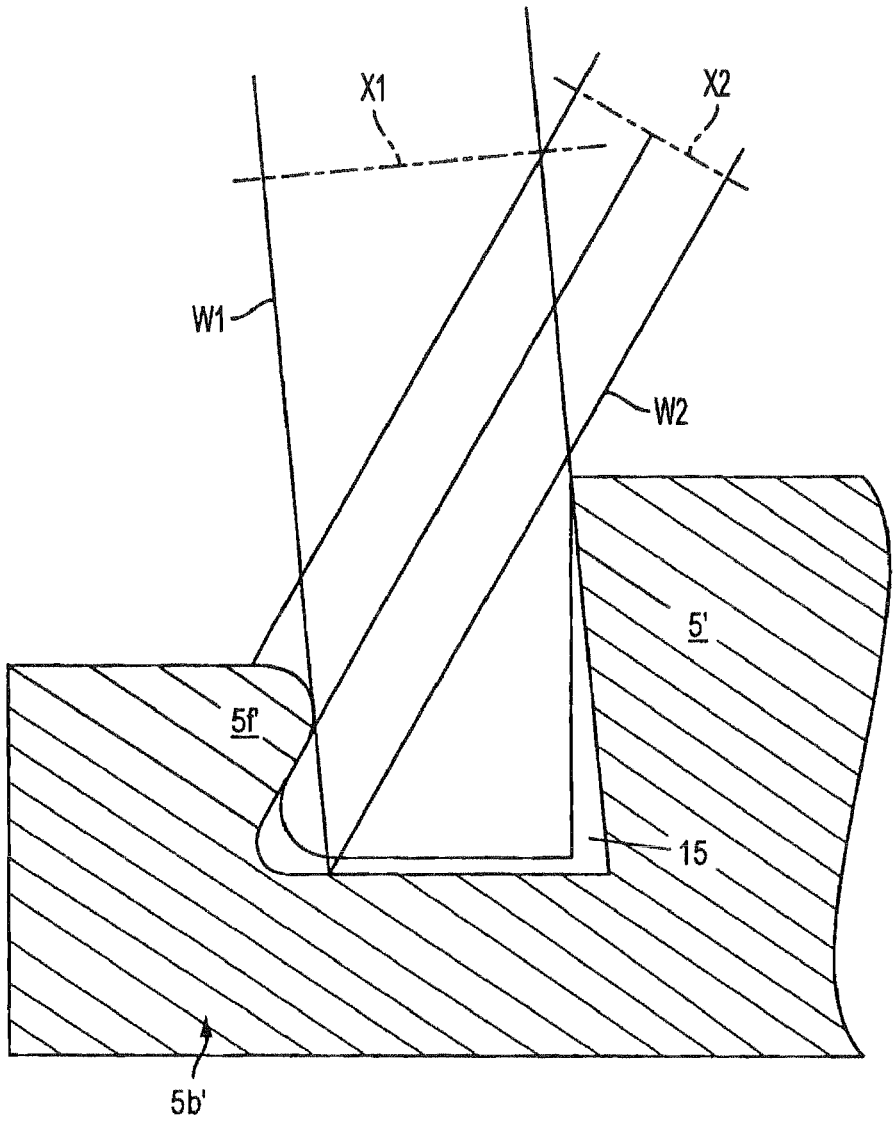
FIG. 4 is a diagrammatic view of a hook connection portion of a retaining profile with a leg at the underside as shown in FIG. 3 and showing the machining tools for producing the undercut configuration.

Finally, FIG. 4 shows a diagrammatic view of a panel 5' with a retaining profile 5*b*' according to the invention. The FIGURE diagrammatically shows how the undercut contour of the retaining projection 5*f'* can be produced by means of two cutting tools W1 and W2, which rotate about the axes X1 and X2. The tools W1 and W2 produce an opening 15 in which a complementary hook projection of a further panel (not shown) can be hooked in detent relationship.

Figure 5:
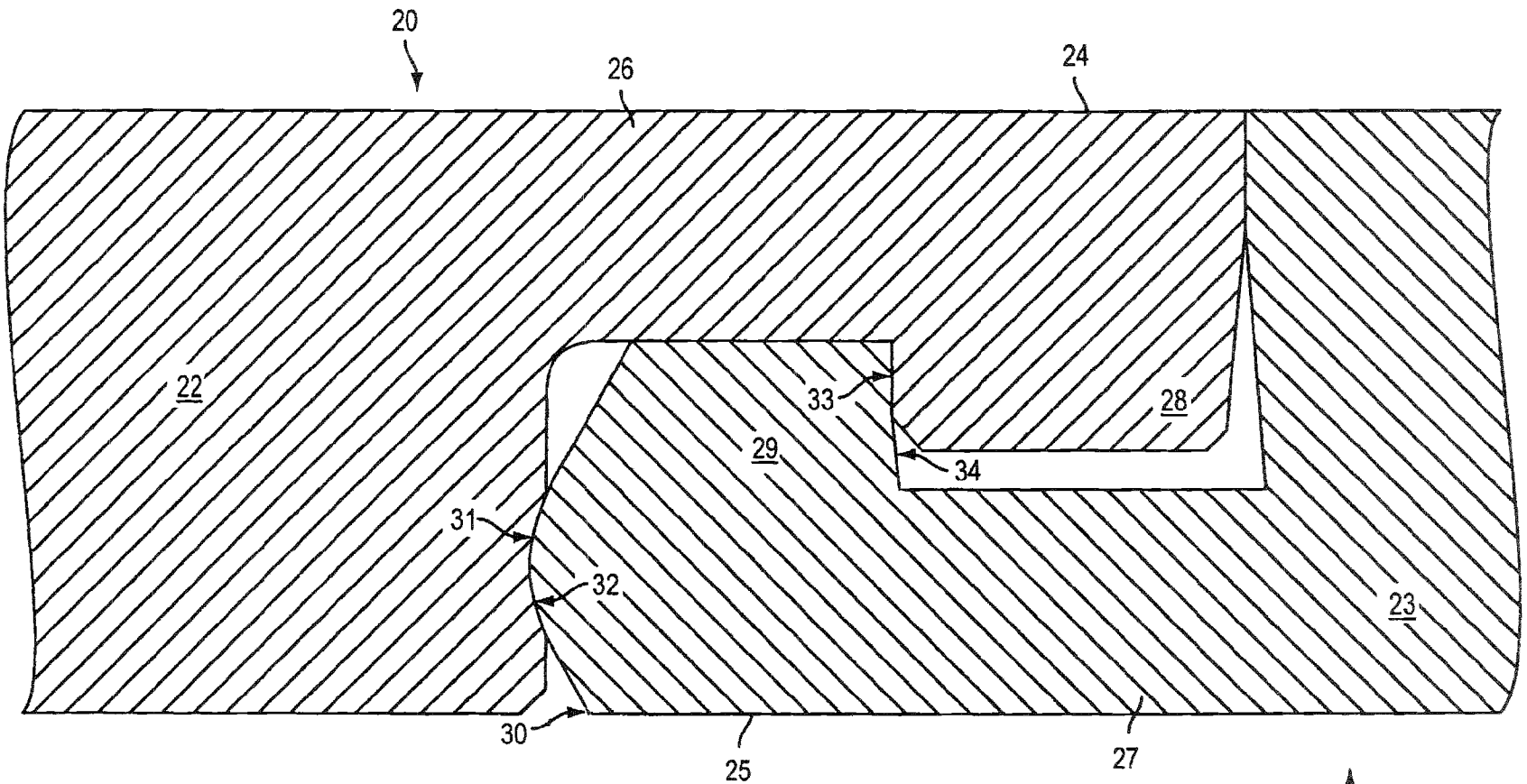
FIG. 5 shows an embodiment of the fastening system with hook elements that can be fixed by way of a retaining element, FIG. 5.1 shows an embodiment of the fastening system with hook elements that can be fixed by way of two retaining elements.

FIGURE shows an alternative embodiment of a fastening system with particular complementary retaining profiles 20 and 21 at the short sides of panels 22 and 23. Once again, the arrangement has hook elements 24 and 25 that, like the foregoing embodiments, have legs 26 and 27 as well as hook projections 28 and 29. The embodiment of FIG. 5 is so constructed that the end 30 of the hook element at the underside of the second panel 23 has at its free end a projecting detent element 31 that engages into a recess 32 of undercut configuration in the hook element 24 at the top side of the first panel 22. The hook elements 24 and 25 can be latched one into the other by a slight pressure and with elastic deformation. The panels 22 and 23 are arrested perpendicularly to the plane of laying thereof by the detent element 31, which engages into the recess 32. The action for arresting the panels 22 and 23 to prevent them from being pulled apart in the longitudinal direction thereof is afforded by retaining surfaces 33 and 34 that are provided on the hook projections 28 and 29 of the hook elements 24 and 25.

FIG. 5.1 shows a further embodiment that is based on the embodiment of FIG. 5. In this respect, similar features in those two Figures are denoted by a prime symbol in FIG. 5.1. In comparison with the embodiment of FIG. 5 the embodiment of FIG. 5.1 is designed in such a way that the end 35 of the hook element 24' at the top side of the first panel 22' has at its free end a projecting detent or latching element 36 which engages into a recess 37 of undercut configuration in the hook element 25' at the underside of the second panel 23'. In order to latch the hook elements 24' and 25' a somewhat greater pressure has to be applied than in the embodiment of FIG. 5. The panels 22' and 23' are arrested more firmly than in the embodiment of FIG. 5 by the detent element 31' engaging into the recess 32' and the additional detent element 36 engaging into the recess 37. The projecting detent elements 31' and 36 respectively of the panels 22' and 23' are in the form of beads or ridges that extend over the entire length of a narrow side. It will be appreciated that, instead of a bead on a hook projection, it is also possible for example to provide a projecting nose having a bevel (not shown), with the bevel of the nose being so oriented that, with increasing progress in the joining operation, the corresponding hook element is gently expanded. The recesses 32' and 37 of undercut configuration in the panels 22' and 23' are in the form of elongate channels that receive the beads in the assembled condition. The bead and the channel can be milled by so-called formatting in a production pass. For the purposes of joining the panels 22' and 23', a bead and a channel have to be fitted one into the other with elastic deformation of the hook elements 24' and 25'. In addition, the embodiments of FIGS. 5 and 5.1 differ in terms of the co-operation of the legs 26, 27, 26', 27' and the hook projections 29, 28, 29', 28'. As shown in FIG. 5, the leg 26 bears against the hook projection 29 and clearance is provided between the hook projection 28 and the leg 27. As shown in FIG. 5.1 clearance is provided between the leg 26' and the hook projection 29' and the hook projection 28' bears against the leg 27'.

Figure 6:
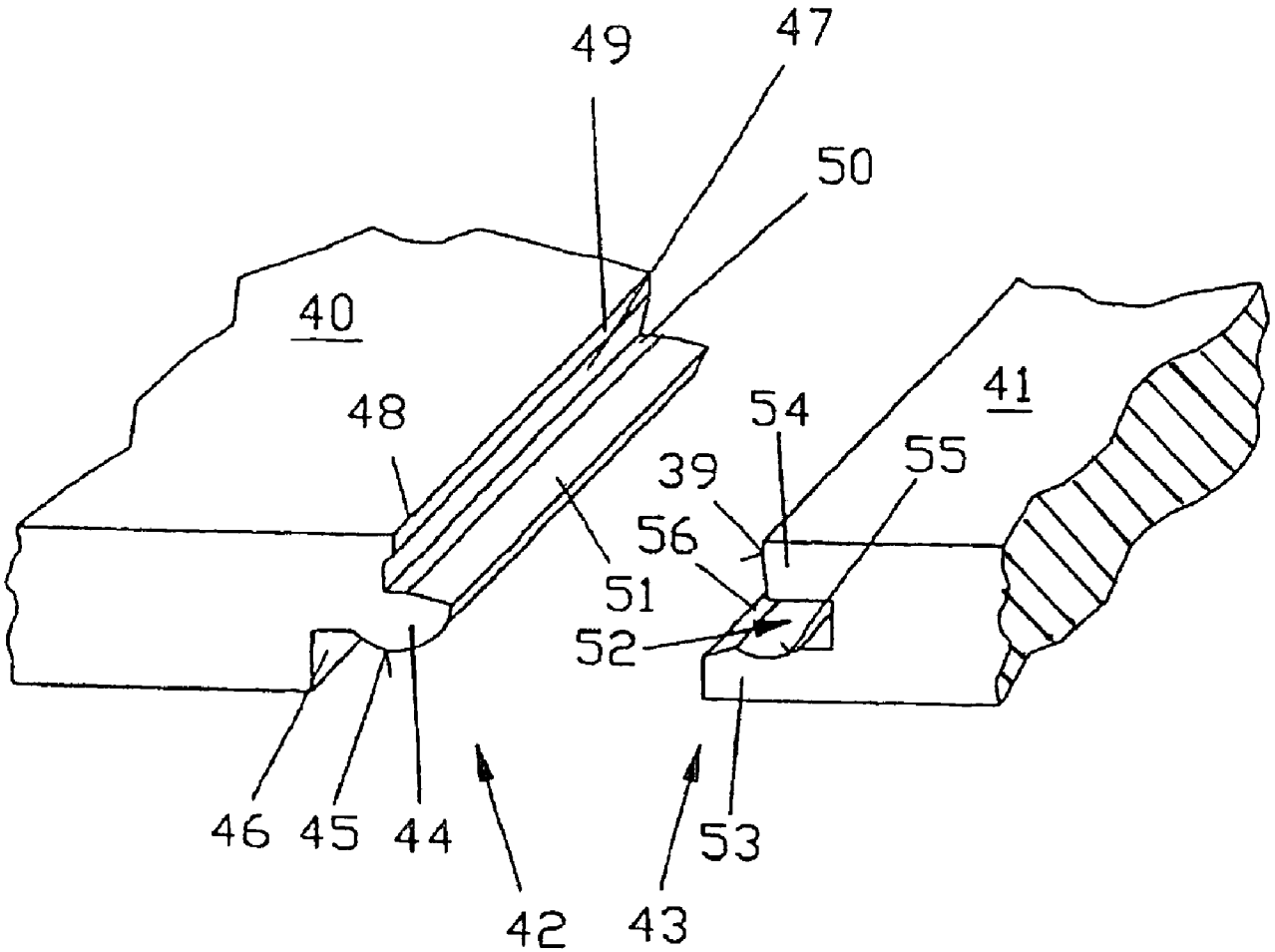
FIG. 6 is a view of a part of a fastening system with complementary positively engaging profiles that, in the assembled condition of two panels, form a hinge.

FIG. 6 illustrates a fastening system for rectangular panels 40 and 41. At their long sides, the panels 40 and 41 have retaining profiles in the form of positively engaging profiles 42 and 43. The mutually opposite positively engaging profiles 42 and 43 of a panel 40 and 41 respectively are complementary to each other. In that way, it is possible to fit to each panel that has already been laid a further panel.

The positively engaging profiles 42 and 43 in FIG. 6 are based on the state of the art of German utility model No G 79 28 703 U1. In particular on the positively engaging profiles of the embodiment which is disclosed in FIGS. 14, 15 and 16 and in the related part of the description of G 79 28 703 U1. The positively engaging profiles 42 and 43 of the present fastening system are the subject of further development in relation thereto in such a way that they permit hinged and flexible connection of panels 40 and 41, which make the fastening system more durable and assist with frequent reuse.

One of the positively engaging profiles 42 is provided with a projection 44 that protrudes from a narrow side. The underside of the projection 44, which, in the laid condition, is towards the base, has a cross-section with a convex curvature 45, for the purposes of affording a hinged connection. The convex curvature 45 is rotatably mounted in the complementary positively engaging profile 43. In the illustrated embodiment, the convex curvature 45 is in the form of a portion of a circle. The part 46 of the narrow side of the panel 40, which is arranged beneath the projection 44 and which in the laid condition is towards the base, is further back from the free end of the projection 44 than the part 47 of the narrow side, which is arranged above the projection 44. In the illustrated embodiment the part 46 of the narrow side, which is arranged beneath the projection 44, is set back approximately twice as far from the free end of the projection 44 as the part 47 of the narrow side, which is arranged above the projection 44. The reason for this is that the circular portion of the convex curvature 45 is relatively wide. In that way the furthest projecting point of the convex curvature 45 of the projection 44 is so arranged that it is somewhat beneath the top edge 48 of the panel 40.

The part 47 of the narrow side, which is arranged above the projection 44, projects at the top side of the panel 40 from the narrow side and forms a joint abutting surface 49. The part 47 of the narrow side is set back between that joint abutting surface 49 and the projection 44 of the panel 40. This ensures that the joint abutting surface 49 with the joint abutting surface 39 of the complementary panel 41 always forms a closed joint at the top side.

The top side of the projection 44, which is in opposite relationship to the convex curvature 45 of the projection 44, has a short straight portion 50 that, in the laid condition, is also arranged parallel to the base U. From that short portion 50 towards the free end the top side of the projection 44 has an inclined removal of material 51 that extends to the free end of the projection 44.

The positively engaging profile 43, which is complementary to the above-discussed positively engaging profile 42, is discussed hereinafter with reference to the panel 41. The positively engaging profile 43 has an opening 52. It is substantially delimited by a lower wall 53 that, in the laid condition, is towards the base U and an upper wall 54. On the inside of the opening 52, the lower wall 53 is provided with a concave curvature 55. That enjoys the function of a bearing shell. The concave curvature 55 is also in the form of a portion of a circle. So that the relatively wide concave curvature 55 has space at the lower wall 53 of the opening 52, the lower wall 53 projects further from the narrow side of the panel 41 than the upper wall 54. At the free end of the lower wall 53, the concave curvature 55 forms an undercut configuration. In the finished laid condition of two panels 40 and 41 that undercut configuration has engaging behind it the projection 44 of the associated positively engaging profile 42 of the adjacent panel 40. The extent by which the projection 44 engages behind that undercut configuration, that is to say the difference between the thickest location of the free end of the lower, wall 53 and the thickness of the lower wall 53 at the deepest point of the concave curvature 55, is such that there is a good compromise between hinged flexibility of the two panels 40 and 41 and a good hold to prevent the positively engaging profiles 42 and 43 from being pulled apart in the plane in which the panels are laid.

The fastening system of the state of the art shown in FIGS. 14, 15 and 16 of utility model No G 79 28 703 U1 has in comparison therewith a considerably greater degree of undercut. That affords extremely stiff connecting locations that give rise to high levels of notch stress due to the loading involved on an irregular base U.

The inside of the upper wall 54 of the opening 52 of the panel 41 is arranged in accordance with the illustrated embodiment parallel to the base U in the laid condition.

The lower wall 53 of the opening 52 of the panel 41, which is towards the base, has on its inside an inclined removal of material 56 which extends to the free end of the lower wall 53. By virtue of that arrangement, the wall thickness of the wall 53 becomes increasingly thinner to the free end of the wall 53. In the illustrated embodiment, the removal of material 56 adjoins the one end of the concave curvature 55.

Figure 7:
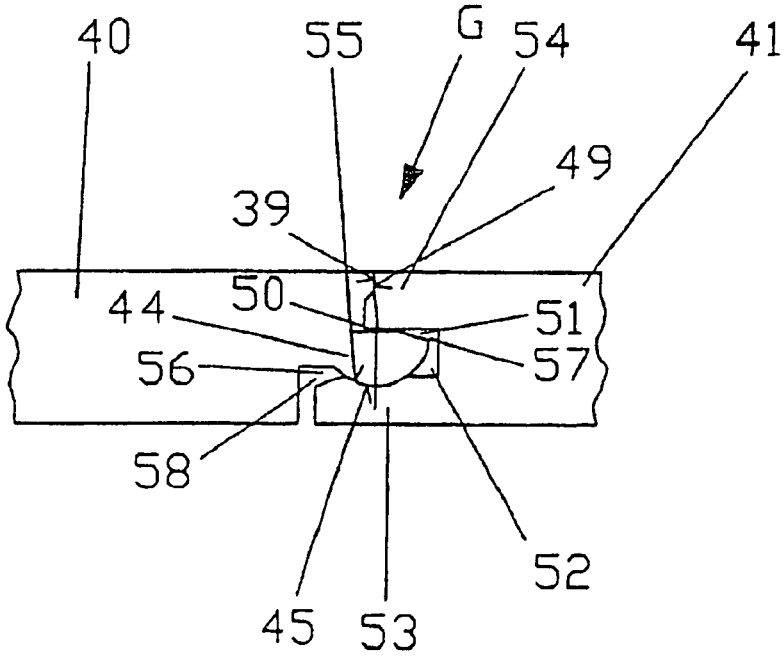
FIG. 7 shows the fastening system of FIG. 6 in the assembled condition.

As can be seen from FIG. 7 the projection 44 of the panel 40 and the opening 52 of the panel 41 form a common hinge G. The removal of material 51 as discussed in relation to FIG. 6 at the top side of the projection 44 of the panel 40 and the removal of material 56 at the lower wall 53 of the opening 52 of the panel 41, in the laid condition of the panels 40 and 41, afford free spaces 57 and 58 respectively for movement, which permit rotary movement for the hinge G in a small angular range.

In the laid condition the short straight portion 50 of the top side of the projection 44 of the panel 40 is in contact with the inside of the upper wall 54 of the opening 52 of the panel 41. In addition, the convex curvature 45 of the projection 44 bears against the concave curvature 55 of the lower wall 53 of the recess 52 of the panel 41.

The lateral joint abutting surfaces 49 and 39, which are towards the top side, of two connected panels 40 and 41 always bear against each other in well-defined fashion. In practice, simultaneous exact contact of the convex curvature 45 of the projection 44 of the panel 40 against the concave curvature 55 of the opening 52 of the panel 41 is not possible. The result of manufacturing tolerances would be either that the joint abutting surfaces 49 and 39 bear exactly one against each other or the convex curvature 45 bears exactly against the concave curvature 55. In practice, the positively engaging profiles 42 and 43 are therefore so designed that the joint abutting surfaces 49 and 39 always bear exactly against each other and the convex curvature 45 and the concave curvature 55 cannot be moved sufficiently far one into the other for exact contact. As however, the manufacturing tolerances are of the order of magnitude of hundredths of a millimeter the convex curvature 45 and the concave curvature 55 also bear snugly virtually one against the other.

Figure 8:
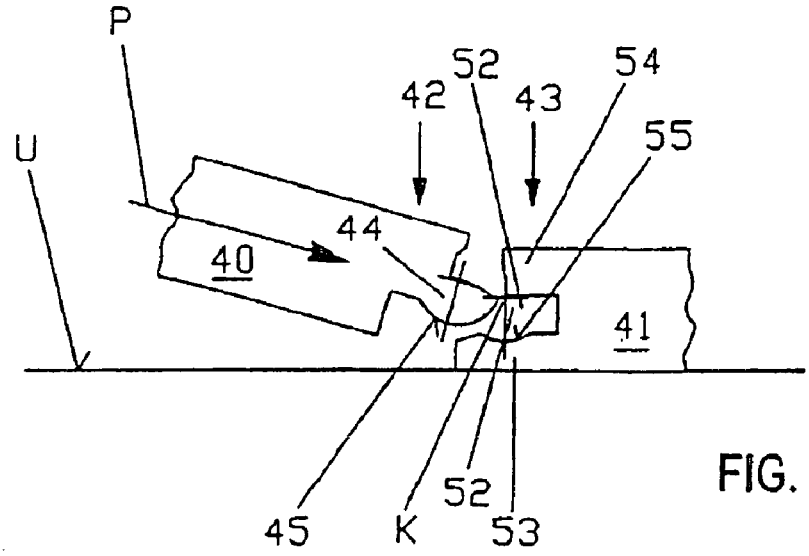
FIG. 8 shows a joining operation with panels as shown in FIG. 6, in which the projection of one panel is fitted in the direction of the arrow into the opening in the second panel and the first panel is then arrested with a rotary movement.

Panels 40 and 41 with the described complementary positively engaging profiles 42 and 43 can be fixed to each other in various ways. As shown in FIG. 8 a panel 41 with an opening 52 has already been laid while a further panel 40 with a complementary projection 44 is inserted in an inclined position in the direction indicated by the arrow P into the opening 52 in the panel 41. Thereafter the panel 40 is rotated about the common centre point K of the portion of the circle of the convex curvature 45 of the projection 44 and the concave curvature 55 of the opening 52 until the panel 40 rests on the base U.

Figure 9:
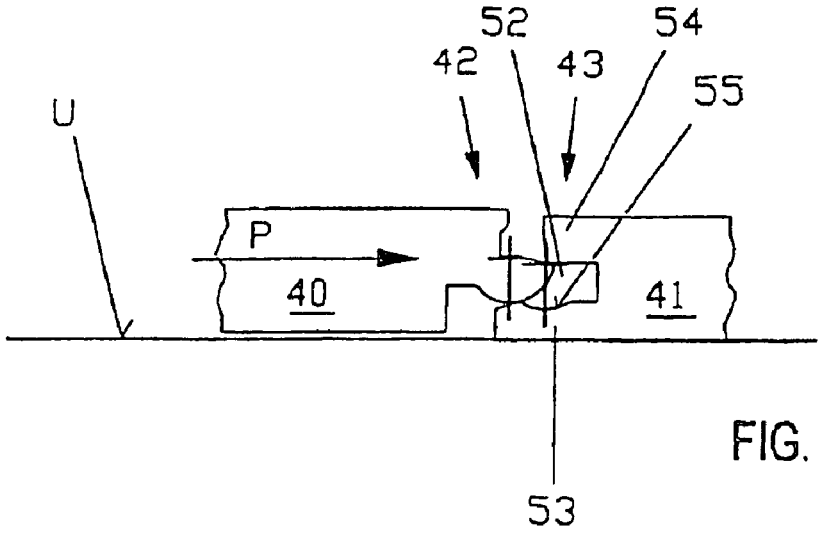
FIG. 9 shows a further joining operation with panels as shown in FIG. 6, in which the projection of the first panel is inserted in parallel relationship with the laying plane into the opening in the second panel.

A further kind of joint between the panels 40 and 41 is shown in FIG. 9, whereby the panel 41 with an opening 52 is laid and a further panel 40 with a projection 44 is displaced in the plane of laying of the panels and perpendicularly to the positively engaging profiles 42 and 43 in the direction indicated by the arrow P until the walls 53 and 54 of the opening 52 of the panel 41 elastically expand a little and the convex curvature 45 of the projection 44 has moved beyond the undercut configuration at the front end of the concave curvature 55 of the lower wall 53 and the definitive laying position is reached.

The latter kind of joint is preferably used for the short sides of the panels 40 and 41 when they are provided with the same complementary positively engaging profiles 42 and 43 as the long sides of the panels 40 and 41.

Figure 10:
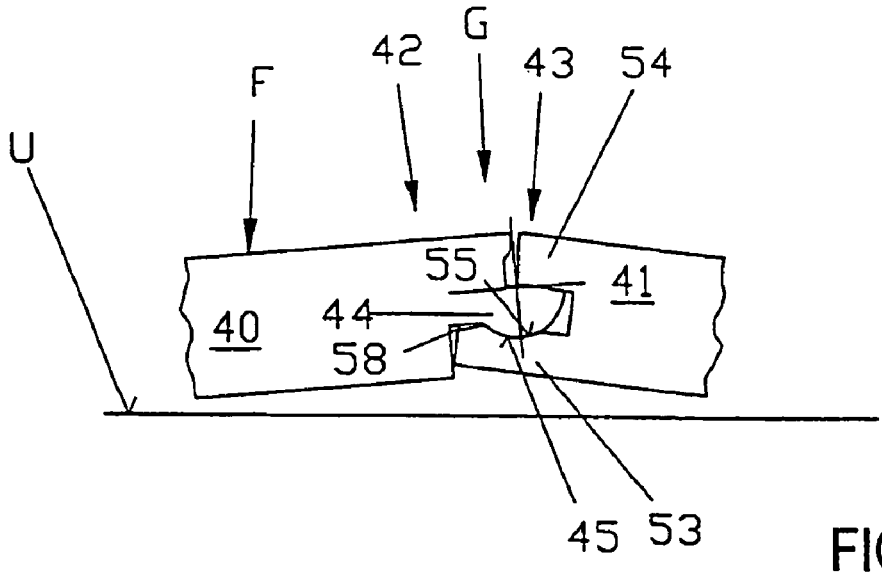
FIG. 10 shows part of the fastening system in the assembled condition as shown in FIG. 7, wherein the common hinge is moved upwardly out of the laying plane and the two panels form a kink.

FIG. 10 shows the fastening system in use. The panels 40 and 41 are lying on an irregular base U. The panel 40 with the positively engaging profile 42 is loaded by a force F on its top side. As a result, the narrow side of the panel 40 with the positively engaging profile 42 has been lifted. The positively engaging profile 43 of the panel 41, which is connected to the positively engaging profile 42, has also been lifted. Due to the hinge G, there is a bend or kink between the two panels 40 and 41. The free spaces 57 and 58 for movement afford space for the rotational motion of the hinge G. The hinge G that is formed from both panels 40 and 41 has been moved upwardly a distance out of the plane in which the panels are laid. The free space 57 for motion has been completely used up for the rotary movement so that the top side of the projection 44 of the panel 40 bears in the region of the removal of material 51 against the inside of the wall 54 of the panel 41. The connecting location is flexible in itself and does not impose any unnecessary flexural loading such as to cause material fatigue, on the positively engaging profiles 42 and 43 involved here.

The damage that occurs early in the case of positively engaging profiles in accordance with the state of the art, due to breakage of the projection or the walls of the positively engaging profiles, is thus avoided.

A further advantage is afforded in terms of a hinge movement as indicated in FIG. 10. This is that the two panels 40 and 41 drop back into their laying plane again due to their own weight, after having been relieved of load. Slight elastic deformation of the walls 53 and 54 of the recess 52 also occurs in that situation. That elastic deformation promotes the panels 40 and 41 in falling back into their laying plane. Only very slight elastic deformation occurs because the pivot point of the hinge G, which is established by the curvatures 45 and 55 in the form of portions of a circle, is within the cross-section of the projection 44 of the panel 40.

Figure 11:
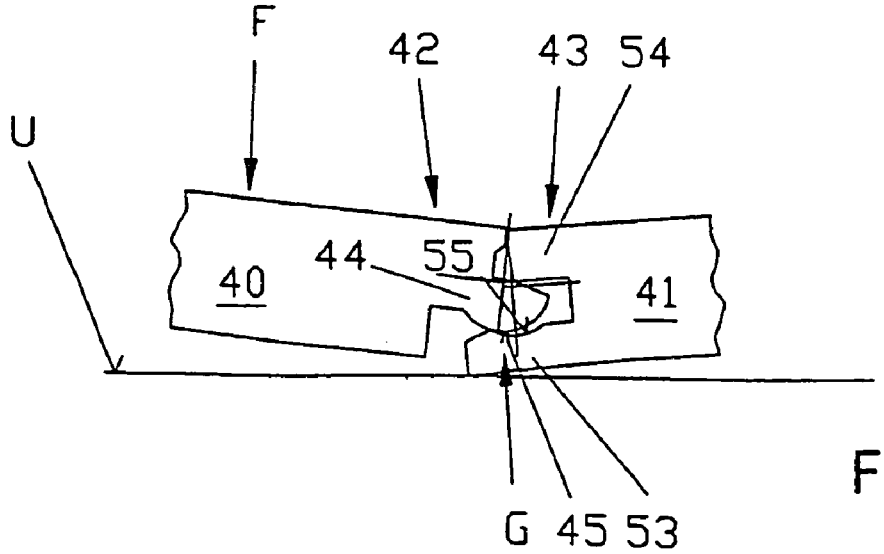
FIG. 11 shows part of the fastening system in the assembled condition as shown in FIG. 7, wherein the hinge is moved downwardly out of the laying plane and the two panels form a kink.
Figure 12:
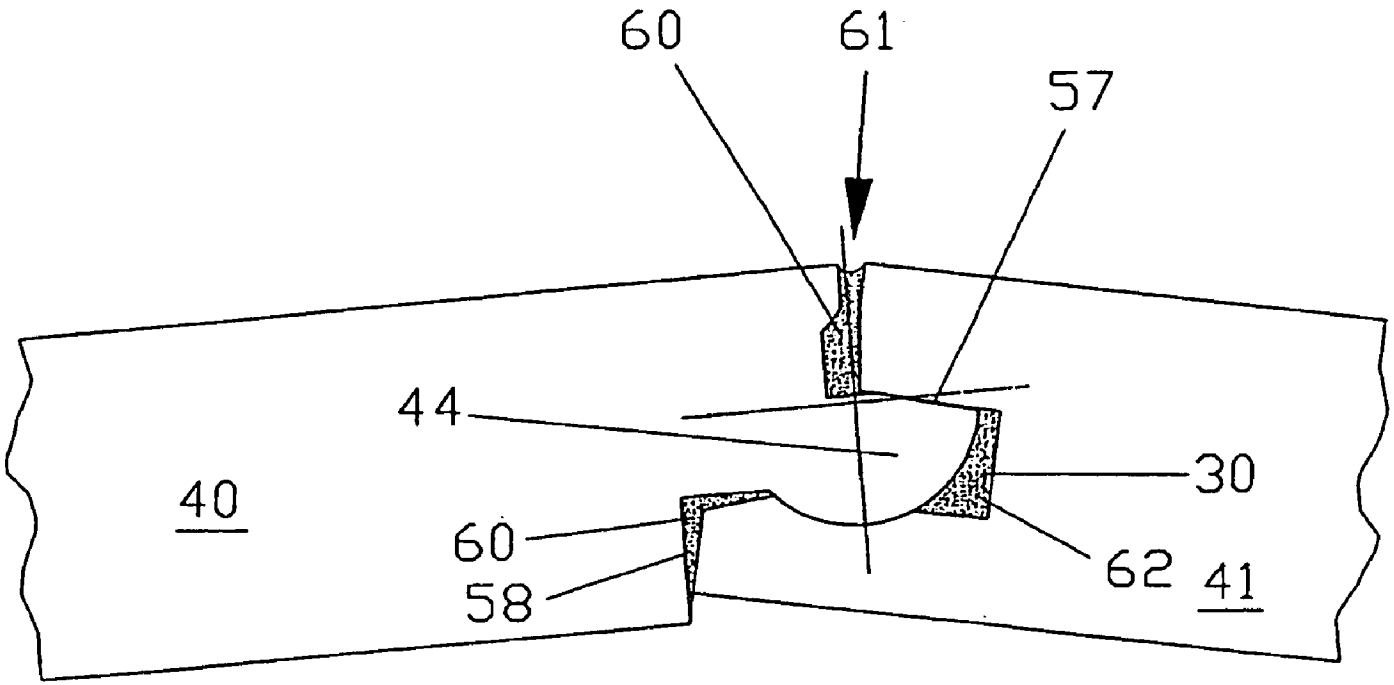
FIG. 12 shows part of a fastening system with panels as shown in FIG. 6 in the laid condition of two panels with a filler between the positively engaging profiles of the long sides.

FIG. 11 shows a hinge movement of two laid panels 40 and 41 in opposite directions of rotation. The panels 40 and 41, which are laid on an irregular base U, are bent downwardly. The structure is such that, upon bending of the connecting location out of the plane in which the panels are laid, towards the base U, markedly greater elastic deformation of the lower wall 53 of the opening 52 occurs than in the event of bending upwardly out of the plane in which the panels are laid. The purpose of this measure is that the downwardly bent panels 40 and 41 cannot return to their laying plane again due to their own weight, after relief of the load thereon. The greater elastic deformation of the lower wall 53 of the opening 52 however produces a stressing force that, after the relief of load, immediately moves the panels 40 and 41 resiliently back into their laying plane again. The described positively engaging profiles 42 and 43 in the present case are formed integrally at the narrow sides of the panels 40 and 41. That is preferably effected by a so-called formatting operation in which in one pass the positively engaging profiles are milled with a plurality of milling tools that are arranged one behind the other. The panels 40 and 41 of the described embodiment substantially comprise an MDF board of a thickness of 8 mm. The MDF board is coated at its top side to be wear-resistant and decoratively. Provided at the underside thereof is a so-called counter-pull layer that compensates for the inherent stresses caused by the coating on the top side. Finally FIG. 12 shows two panels 40 and 41 in the laid condition, using a fastening system with a filler 60 which hardens in a soft-elastic fashion. In this case the free spaces 57 and 58 for movement of the hinge G also serve as a kind of adhesive pocket into which a soft-elastic filler 60 is introduced. In addition the joint 61 at the top side is closed with the filler 60 so that no moisture and no dirt can penetrate therein. In addition the bottom 62 of the recess 52 is provided with the filler 60.

The filler 60 further provides that, in the bent condition of two panels 40 and 41, the filler 60 which is deformed in itself, by virtue of the inherent spring action thereof, is involved in returning the panels 40 and 41 to the plane in which they are laid.

| List of references | |
|---|---|
| 1 | floor covering |
| 2 | fastening system |
| 3 | panel |
| 4 | panel |
| 4' | panel |
| 4a | retaining profile |
| 4b | retaining profile |
| 4c | hook element |
| 4d | hook element |
| 4e | leg |
| 4f | hook projection |
| 4f' | hook projection |
| 4g | retaining surface |
| 5 | panel |
| 5' | panel |
| 5b | retaining profile |
| 5e | leg |
| 5f | hook projection |
| 5f' | hook projection |
| 5g | retaining surface |
| 5h | end |
| 6 | panel |
| 7 | underside |
| 8 | top side |
| 9 | top side |
| 11 | opening |
| 12a | adhesive pocket |
| 12b | adhesive pocket |
| 12c | adhesive pocket |
| 12d | adhesive pocket |
| 12e | adhesive pocket |
| 12f | adhesive pocket |
| 12g | adhesive pocket |
| 12h | adhesive pocket |
| 13 | inside surface |
| 14 | end |
| 15 | opening |
| 16 | top side |

-continued

| List of references | |
|---|---|
| 20 | retaining profile |
| 21 | retaining profile |
| 22 | panel |
| 23 | panel |
| 24 | hook element |
| 25 | hook element |
| 26 | leg |
| 27 | leg |
| 28 | hook projection |
| 29 | hook projection |
| 30 | end |
| 31 | detent element |
| 32 | recess |
| 33 | retaining surface |
| 34 | retaining surface |
| 35 | end |
| 36 | detent element |
| 37 | recess |
| 39 | join abutting surface |
| 40 | panel |
| 41 | panel |
| 42 | positively engaging profile |
| 43 | positively engaging profile |
| 44 | projection |
| 45 | convex curvature |
| 46 | part of the narrow side |
| 47 | part of the narrow side |
| 48 | top edge |
| 49 | join abutting surface |
| 50 | portion of 44 |
| 51 | removal of material |
| 52 | opening |
| 53 | lower wall |
| 54 | upper wall |
| 55 | concave curvature |
| 56 | removal of material |
| 57 | free space for movement |
| 58 | free space for movement |
| 60 | filler |
| 61 | filler |
| 62 | filler |
| 64 | panel |
| 65 | short side |
| 66 | short side |
| 67 | long side |
| 68 | long side |
| G | hinge |
| K | common centre point |
| L1 | clearance |
| L1' | clearance |
| L2 | clearance |
| P | direction of arrow |
| U | base |
| X1 | axis |
| X2 | axis |
| W1 | tool |
| W2 | tool |

The invention claimed is:

1. A fastening system for panels comprising:

at least one pair of oppositely disposed retaining profiles arranged on each of the panels; a first of the pair of retaining profiles arranged on a first edge of each of the panels; and a second of the pair of retaining profiles arranged on a second edge of each of the panels, the first edge being opposite the second edge on each of the panels;

the first of the pair of retaining profiles having a first, hook element and the second of the pair of retaining profiles having a second hook element;

the first hook element complementing the second hook element such that the first hook element on a first panel hooks directly and vertically into the second hook element on a second panel to fasten the first panel to the second panel;

the first hook element having a first hook projection connected to the first edge of each of the panels by a first leg, the first leg projecting from an upper portion of the first edge of each of the panels, the first hook projection having an inclined retaining surface, such that the first hook projection is reduced from a distal end of the first hook projection to a proximal end of the first hook projection;

the second hook element having a second hook projection connected to the second edge of each of the panels by a second leg, the second leg projecting from a lower portion of the second edge of each of the panels, the second hook projection having an inclined retaining surface, such that the second hook projection is reduced from a distal end of the second hook projection to a proximal end of the second hook projection;

wherein, in a fastened position, the inclined retaining surface of the first hook projection of the first panel bears against the inclined retaining surface of the second hook projection of the second panel to fasten the first panel against the second panel so as to afford a gap-free floor surface;

the distal end of the first hook projection of the first panel bears against the second leg of the second panel, and a space is provided between the distal end of the second hook projection of the second panel and the first leg of the first panel, the space extending vertically between the distal end of the second hook projection of the second panel and first leg of the first panel and extending horizontally between the proximal end of the first hook projection of the first panel and the first edge of the first panel.

2. The fastening system according to claim 1, wherein said first leg projecting approximately perpendicularly from the first edge of the first panel, said first hook projection projects vertically downward from a distal end of the first leg, said second leg projecting approximately perpendicularly from the second edge of the second panel, and the second hook projection projects vertically upward from a distal end of the second leg.

3. The fastening system according to claim 1, wherein each of the first and second inclined retaining surfaces engage each other such that each of the first and second hook elements hook one into the other only by elastic deformation.

4. The fastening system according to claim 3, wherein a clearance is provided between the distal end of the second hook projection of the second panel and the first edge of the first panel, and the proximal end of the first hook projection at an upper portion of the first panel bears against the second panel at least in a region of the upper portion of the second edge of the second panel.

5. The fastening system according to claim 1, wherein intermediate spaces in the fastened condition of the first and second panels form adhesive pockets.

6. The fastening system according to claim 1, wherein the panels substantially comprise an MDF, HDF, or chipboard material.

7. The fastening system according to claim 1, wherein, an inclined adhesive pocket is formed between an inwardly inclined end of the first panel and an outwardly inclined portion of the second panel, which mates with the end of the first panel at top sides of the first panel and the second panel and extends downward toward the leg of the second panel.

* * * * *